US009076583B2

(12) United States Patent
Ando et al.

(10) Patent No.: US 9,076,583 B2
(45) Date of Patent: Jul. 7, 2015

(54) LINEAR SOLENOID

(71) Applicant: DENSO CORPORATION, Kariya, Aichi-pref. (JP)

(72) Inventors: Motoyoshi Ando, Nagoya (JP); Thanh Do Nguyen, Nagoya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/178,474

(22) Filed: Feb. 12, 2014

(65) Prior Publication Data

US 2014/0225690 A1 Aug. 14, 2014

(30) Foreign Application Priority Data

Feb. 14, 2013 (JP) ..... 2013-026176

(51) Int. Cl.
*H01F 3/00* (2006.01)
*H01F 7/16* (2006.01)
*H01F 7/127* (2006.01)

(52) U.S. Cl.
CPC ..... *H01F 7/1607* (2013.01); *H01F 7/127* (2013.01)

(58) Field of Classification Search
CPC ..... H01F 7/1607; H01F 7/127; H01F 7/081; H01F 3/14
USPC ..... 335/84, 91, 153, 281, 220–229, 255, 335/297, 289; 251/129.01–129.15
See application file for complete search history.

(56) References Cited

U.S. PATENT DOCUMENTS

| | | | | | |
|---|---|---|---|---|---|
| 4,971,115 | A * | 11/1990 | Tinholt | 137/625.65 |
| 5,462,253 | A * | 10/1995 | Asthana et al. | 251/121 |
| 6,050,542 | A * | 4/2000 | Johnson et al. | 251/129.15 |
| 6,604,726 | B2 * | 8/2003 | Kumar | 251/129.16 |
| 7,468,647 | B2 * | 12/2008 | Ishibashi et al. | 335/281 |
| 8,134,436 | B2 * | 3/2012 | Yasoshima | 335/220 |
| 2001/0009164 | A1 * | 7/2001 | Motoki et al. | 137/625.65 |
| 2006/0011245 | A1 | 1/2006 | Suzuki et al. | |
| 2006/0017535 | A1 * | 1/2006 | Nagasaki | 335/220 |
| 2006/0243938 | A1 | 11/2006 | Ishibashi et al. | |
| 2007/0023722 | A1 * | 2/2007 | Oishi | 251/129.15 |

FOREIGN PATENT DOCUMENTS

| | | |
|---|---|---|
| JP | 2009-180261 | 8/2009 |
| JP | 2011-228568 | 11/2011 |
| JP | 2012-241733 | 10/2012 |

OTHER PUBLICATIONS

Office Action issued in corresponding JP App. No. 2013-26176 (mailed Feb. 3, 2015) with partial English translation.
Ando, et al., U.S. Appl. No. 14/178,467, filed Feb. 12, 2014.

* cited by examiner

*Primary Examiner* — Bernard Rojas
(74) *Attorney, Agent, or Firm* — Nixon & Vanderhye P.C.

(57) ABSTRACT

A communication hole is formed in a peripheral wall portion of a yoke. The communication hole communicates between an inside and an outside of the yoke. A gap, which is formed between one end portion of the coil and a bottom wall portion of the yoke, overlaps with the communication hole in an axial direction.

2 Claims, 3 Drawing Sheets

LINEAR SOLENOID

CROSS REFERENCE TO RELATED APPLICATION

This application is based on and incorporates herein by reference Japanese Patent Application No. 2013-26176 filed on Feb. 14, 2013.

TECHNICAL FIELD

The present disclosure relates to a linear solenoid.

BACKGROUND

For example, JP4569371B2 (corresponding to US2006/0243938A1) recites a linear solenoid, which includes a plunger made of a magnetic material, a yoke made of a magnetic material and a stator core. The stator core includes a magnetically attracting core, a slide core and a magnetic shield portion, which are formed integrally.

In this linear solenoid, the plunger is placed on a radially inner side of a coil and is movable in an axial direction. The yoke is configured into a cup form and includes an opening, a bottom wall portion and a peripheral wall portion. The peripheral wall portion covers an outer peripheral portion of the coil, and the bottom portion covers one axial end of the coil.

The magnetically attracting core of the stator core is made of a magnetic material and magnetically attracts the plunger toward the other axial side, which is opposite from the one axial end of the coil, with a magnetic flux generated through energization of the coil. The slide core is made of the magnetic material and is configured into a tubular form. The slide core is placed on the radially inner side of the coil and covers an outer peripheral portion of the plunger. The slide core axially slidably supports the plunger and conducts the magnetic flux between the slide core and the plunger in a radial direction. The magnetic shield portion limits flow of the magnetic flux between the magnetically attracting core and the slide core.

The stator core is inserted into an inside of the yoke from one axial side of the stator core where the slide core is located, and the stator core is fixed to the yoke at the opening of the yoke.

In the linear solenoid of JP4569371 B2 (corresponding to US2006/0243938A1), breathing passages are formed to enable smooth axial movement of the plunger at the time of starting the energization of the coil and at the time of stopping the energization of the coil.

The breathing passages include a first breathing passage, which is formed as a through-hole that axially extends through the plunger to conduct the fluid between one end side of the plunger and the other end side of the plunger. The breathing passages also include a second breathing passage, which conducts the fluid between the inside and an outside of the yoke at a location around the one axial end of the plunger and is formed as an annular gap (also referred to as an annular space) between the outer peripheral portion of the coil and the peripheral wall portion of the yoke. This annular gap is communicated to the outside of the yoke through a terminal output opening of the yoke.

However, since the second breathing passage is formed between the outer peripheral portion of the coil and the peripheral wall portion of the yoke in the linear solenoid of JP4569371B2 (corresponding to US2006/0243938A1), it is required to increase the inner diameter of the yoke to form the annular gap between the outer peripheral portion of the coil and the peripheral wall portion of the yoke. Therefore, the radial size of the linear solenoid is disadvantageously increased. As a result, in order to meet a demand of increasing the number of winding turns of the coil and a demand of reducing the radial size while forming the second breathing passage, another structure is required.

JP4569371B2 (corresponding to US2006/0243938A1) and JP2012-241733A teach a breathing groove formed in the bottom wall portion of the yoke. However, even in the case where the breathing groove is formed in the bottom wall portion of the yoke, it is still required to form the annular gap between the outer peripheral portion of the coil and the peripheral wall portion of the yoke to form the second breathing passage. Thus, it is still required to communicate the annular gap to the outside of the yoke through the terminal output opening of the yoke, and thereby the radial size is disadvantageously increased.

SUMMARY

The present disclosure is made in view of the above disadvantages. According to the present disclosure, there is provided a linear solenoid, which includes a coil, a plunger, a yoke, a stator core, and a communication hole. The plunger is made of a magnetic material. The plunger is placed on a radially inner side of the coil and is movable in an axial direction. The yoke is made of a magnetic material and is configured into a cup form. The yoke includes an opening, a bottom wall portion, and a peripheral wall portion. The bottom wall portion covers one axial end portion of the coil located on one axial side. The peripheral wall portion is configured into a tubular form and covers an outer peripheral portion of the coil. The stator core includes a magnetically attracting core and a slide core. The magnetically attracting core is made of a magnetic material and magnetically attracts the plunger toward another axial side that is axially opposite from the one axial side with a magnetic flux generated through energization of the coil. The slide core is made of a magnetic material and is configured into a tubular form. The slide core is placed on a radially inner side of the coil and covers an outer peripheral portion of the plunger. The slide core axially slidably supports the plunger and conducts the magnetic flux between the slide core and the plunger in a radial direction. The magnetically attracting core and the slide core are integrated with each other along with a magnetic shield portion, which is interposed between the magnetically attracting core and the slide core in the axial direction. The stator core is inserted into an inside of the yoke from one axial side of the stator core where the slide core is located. The stator core is fixed to the yoke at the opening. The communication hole is formed in the peripheral wall portion and communicates between the inside and an outside of the yoke. A gap, which is formed between the one axial end portion of the coil and the bottom wall portion, overlaps with the communication hole in the axial direction.

BRIEF DESCRIPTION OF THE DRAWINGS

The drawings described herein are for illustration purposes only and are not intended to limit the scope of the present disclosure in any way.

DETAILED DESCRIPTION

An embodiment of the present disclosure will be described with reference to the accompanying drawings.

Figure 1:
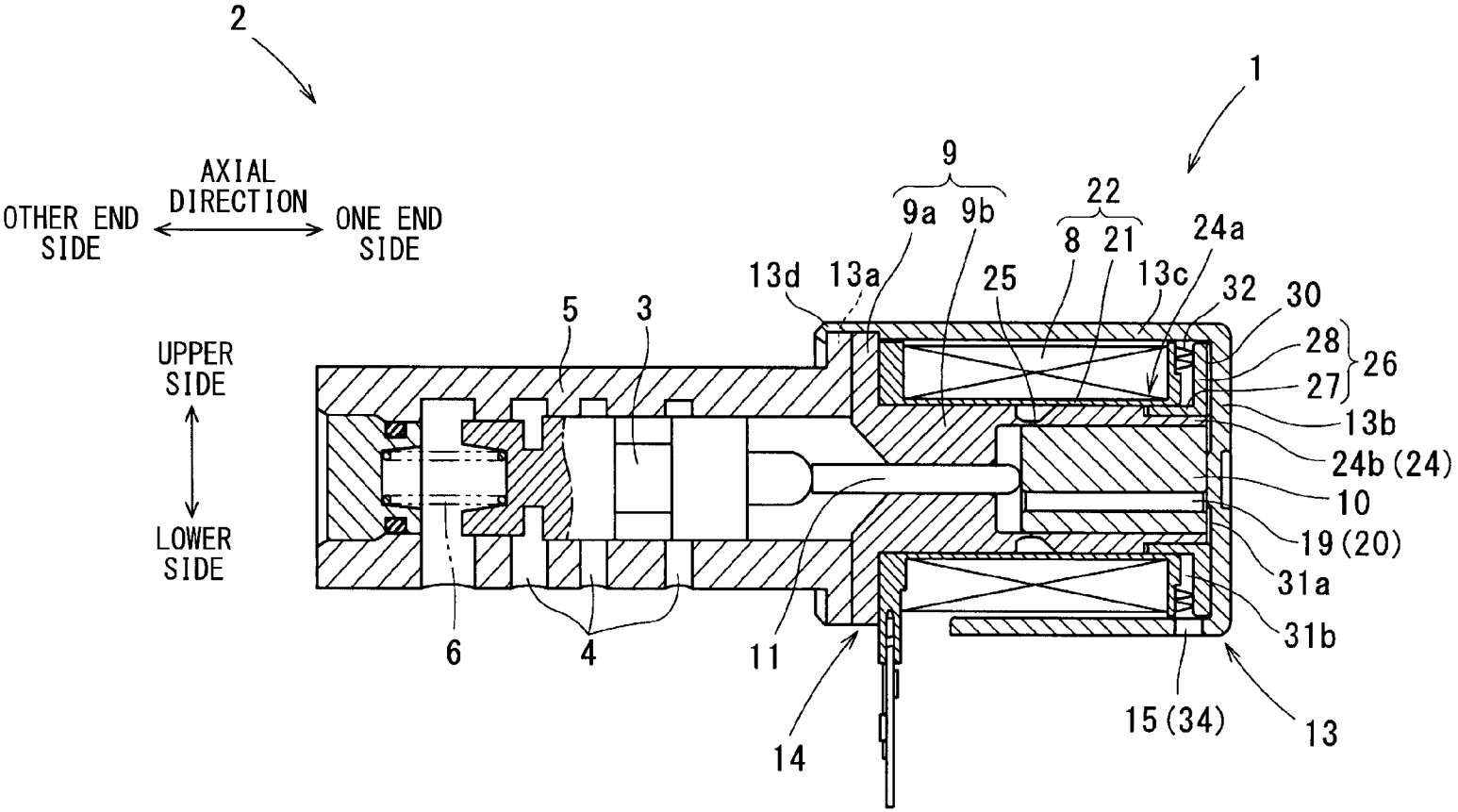
FIG. 1 is a longitudinal cross-sectional view of a hydraulic pressure control valve including a linear solenoid according to an embodiment of the present disclosure.
Figure 2A:
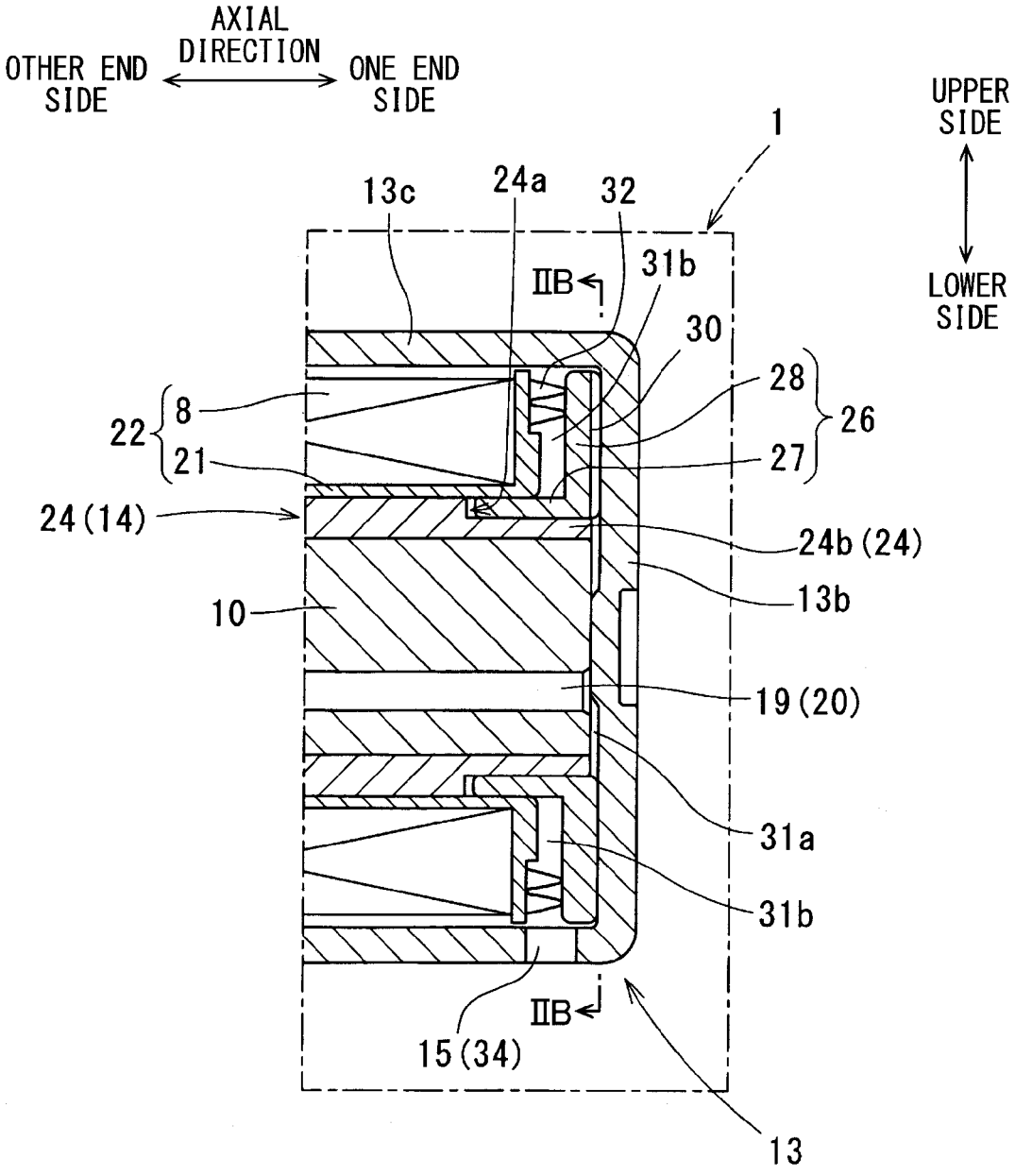
FIG. 2A is a partial enlarged longitudinal cross-sectional view showing a main feature of the linear solenoid according to the embodiment.

A structure of a linear solenoid 1 of the present embodiment will be described with reference to FIGS. 1 to 2B.

For example, the linear solenoid 1 is used as an actuator that generates an axial thrust force for driving a spool 3, which serves as a valve element of a hydraulic pressure control valve 2.

The hydraulic pressure control valve 2 controls a hydraulic pressure (also referred to as an oil pressure) of a control subject by supplying hydraulic oil to the control subject or draining the hydraulic oil from the control subject. The hydraulic pressure control valve 2 is installed in, for example, a hydraulic pressure control apparatus of an automatic transmission of a vehicle (e.g., an automobile) such that the hydraulic pressure control valve 2 is immersed in the hydraulic oil.

The spool 3 is axially slidably received in an inside of a sleeve 5, which is configured into a tubular form and has various ports 4. The linear solenoid 1 is integrally installed to one end side (also referred to as one axial end side or one axial side) of the spool 3 and the sleeve 5. A spring 6 is installed in the inside of the sleeve 5. The spring 6 urges the spool 3 in a direction that is opposite from a direction of the thrust force outputted from the linear solenoid 1. The spool 3 is driven to change a communication state between each corresponding ones of the ports 4 based on a balance of the thrust force outputted from the linear solenoid 1, the urging force of the spring 6 and a feedback force of the hydraulic pressure.

Now, the linear solenoid 1 will be described in detail.

The linear solenoid 1 generates the thrust force by magnetically attracting the plunger 10 to a magnetically attracting core 9 toward the other end side (also referred to as the other axial end side or the other axial side), which is opposite from the one end side, upon generation of a magnetic flux through energization of the coil 8. The generated thrust force is conducted to the spool 3 through a shaft 11.

The linear solenoid 1 includes the plunger 10, a yoke 13, a stator core 14 and a communication hole 15.

The plunger 10 is a magnetic metal body, which is made of a ferromagnetic material and is configured into a generally cylindrical form. The plunger 10 directly slidably contacts an inner peripheral surface of the stator core 14. The plunger 10 is axially movable at a location, which is on a radially inner side of the coil 8.

An end surface (the other end surface) of the plunger 10, which is located on the spool 3 side in the axial direction, contacts a distal end of the shaft 11. The plunger 10 is urged along with the spool 3 by the urging force of the spring 6 conducted to the spool 3 in the axial direction. A through-hole 19 extends through the plunger 10 in the axial direction. The through-hole 19 functions as a first breathing passage 20, through which fluid is moved between the one end side of the plunger 10 and the other end side of the plunger 10.

The coil 8 has a conductive wire (e.g., an enamel wire), which is covered with a dielectric cover and is wound multiple times around a bobbin 21 made of a resin material. The coil 8 and the bobbin 21 form a coil assembly 22.

The yoke 13 is made of a ferromagnetic material and is configured into a cup form. Specifically, the yoke 13 includes an opening 13*a*, a bottom wall portion 13*b* and a peripheral wall portion (also referred to as a lateral wall portion) 13*c*. The peripheral wall portion 13*c* is configured into a tubular form and covers an outer peripheral portion of the coil 8. The bottom wall portion 13*b* covers one axial end portion of the coil assembly 22 located on one axial side. The yoke 13 conducts a magnetic flux, which is generated through energization of the coil 8. A claw 13*d* is formed at the other axial end of the yoke 13, which forms the opening 13*a*. The claw 13*d* is plastically deformed against and is thereby secured to one axial end portion of the sleeve 5 after installation of the plunger 10, the stator core 14 and the coil assembly 22 into the inside of the yoke 13.

The stator core 14 is placed on the radially inner side of the coil assembly 22 and also on the other axial side of the coil assembly 22. The stator core 14 includes a magnetically attracting core 9, a magnetic shield portion 25 and a slide core 24, which are integrated together such that the magnetic shield portion 25 is interposed between the magnetically attracting core 9 and the slide core 24 in the axial direction.

The magnetically attracting core 9 is made of a ferromagnetic material. The magnetically attracting core 9 magnetically attracts the plunger 10 toward the other end side that is axially opposite from the one end side with the magnetic flux generated through energization of the coil 8. The magnetically attracting core 9 includes a flange portion 9*a* and an attracting portion 9*b*. The flange portion 9*a* is located on the other end side of the coil assembly 22 and is magnetically coupled with the opening end of the yoke 13. The attracting portion 9*b* is placed on the radially inner side of the coil assembly 22 and is axially opposed to the plunger 10. The attracting portion 9*b* axially slidably supports the shaft 11.

The slide core 24 is made of a ferromagnetic material and is configured into a cylindrical tubular form. The slide core 24 is connected to the one end of the magnetically attracting core 9 through the magnetic shield portion 25. The slide core 24 is placed on the radially inner side of the coil assembly 22 and covers the outer peripheral portion of the plunger 10 along the entire circumferential extent and the entire axial extent of the plunger 10. The slide core 24 axially slidably supports the plunger 10 and conducts the magnetic flux between the slide core 24 and the plunger 10 in the radial direction. One of an outer peripheral surface of the plunger 10 and an inner peripheral surface of the slide core 24 is surface treated to form a non-magnetic coating or layer thereon, so that stucking of the plunger 10 to the slide core 24 is limited.

The magnetic shield portion 25 limits direct flow of the magnetic flux between the magnetically attracting core 9 and the slide core 24 and is formed as a thin wall portion, which has a large magnetic resistance.

The stator core 14 is inserted into the inside of the yoke 13 from one axial side of the stator core 14 where the slide core 24 is located. The stator core 14 is fixed to the yoke 13 at the flange portion 9*a* through the plastic deformation of the claw 13*d* against the end portion of the sleeve 5.

A stepped portion 24*a*, which is configured into a form of a step, is formed in an outer peripheral portion of the slide core 24. The stepped portion 24*a* is stepped to reduce an outer diameter of one portion of the slide core 24 located on one axial side of the stepped portion 24*a* in comparison to the other portion (another portion) of the slide core 24 located on the other axial side (another axial side) of the stepped portion 24*a*. Specifically, the outer diameter of the one portion of the slide core 24 located on the one axial side of the stepped portion 24*a*, which is axially opposite from the magnetically attracting core 9, is reduced in comparison to the other portion of the slide core 24 located on the other axial side of the stepped portion 24*a* where the magnetically attracting core 9 is placed. Hereinafter, the one portion of the slide core 24, which has the reduced outer diameter in comparison to the other portion of the slide core 24, will be also referred to as a reduced diameter portion 24*b*.

A ring core 26 is installed to an outer peripheral part of the reduced diameter portion 24*b* to enhance the conduction of the magnetic flux between the bottom wall portion 13*b* of the yoke 13 and the slide core 24.

The ring core 26 is made of a ferromagnetic material and is formed as a cylindrical body having a flange at one axial end of the cylindrical body. The ring core 26 has a first conducting portion 27 and a second conducting portion 28. The first conducting portion 27 covers the outer peripheral part of the reduced diameter portion 24*b* and is slidable relative to the reduced diameter portion 24*b*. The first conducting portion 27 conducts the magnetic flux between the first conducting portion 27 and the slide core 24 in the radial direction. The second conducting portion 28 is the flange, which is configured into a ring plate form and radially outwardly projects from the first conducting portion 27. The second conducting portion 28 contacts the bottom wall portion 13*b* and conducts the magnetic flux between the second conducting portion 28 and the bottom wall portion 13*b* in the axial direction.

Figure 2B:
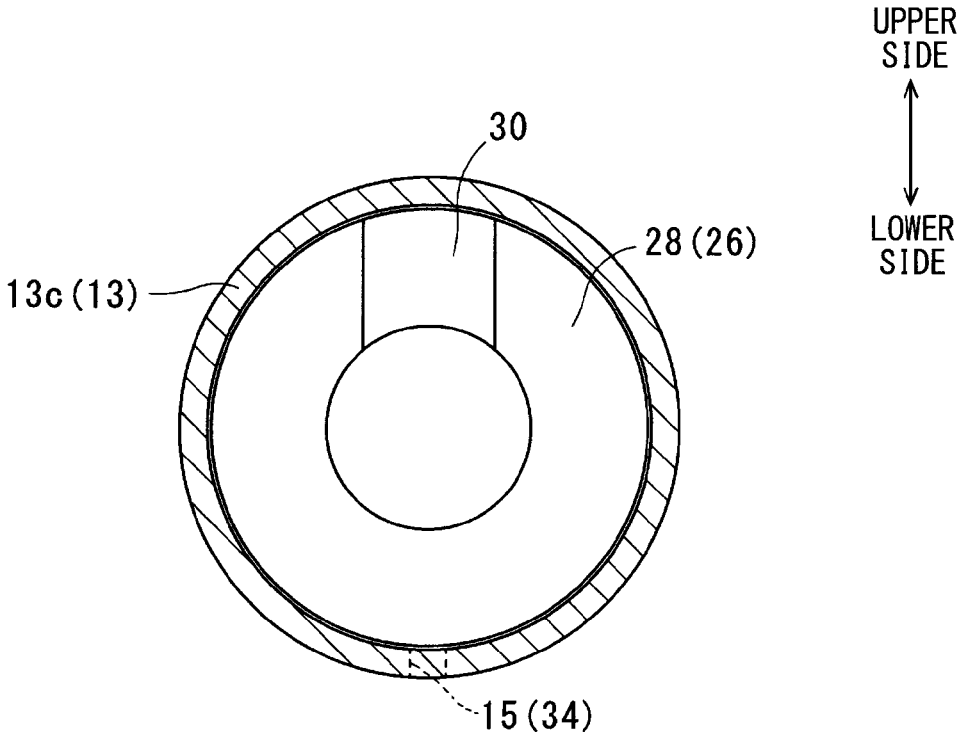
FIG. 2B is a transverse cross-sectional view of the linear solenoid taken along line IIB-IIB in FIG. 2A according to the embodiment, showing a cross section of a peripheral wall portion of a yoke and a bottom surface of a ring core while eliminating a plunger and a slide core for the sake of simplicity.

A groove 30 is formed in one end surface of the second conducting portion 28 and radially extends in the direction, which is from the central axis of the linear solenoid 1 to the upper side immediately above the central axis of the linear solenoid 1 in FIG. 2B. The groove 30 communicates between a space 31*a* and a space 31*b*. The space 31*a* is formed on the one end side of the plunder 10 and is defined by the reduced diameter portion 24*b*, the first conducting portion 27 and the bottom wall portion 13*b*. Furthermore, the space 31*b* is defined between the coil assembly 22 and the second conducting portion 28 in the axial direction.

The second conducting portion 28 is urged against the bottom wall portion 13*b* by an urging member (urging means) 32 to enhance the conduction of the magnetic flux between the yoke 13 and the ring core 26. The urging member 32 may be, for example, a rubber, a Belleville spring or a wave washer.

The communication hole 15 is formed in the peripheral wall portion 13*c* and communicates between the inside and an outside of the yoke 13 in the radial direction. The communication hole 15 extends through the peripheral wall portion 13*c* in the radial direction, which is from the central axis of the linear solenoid 1 to the lower side immediately below the central axis of the linear solenoid 1 in FIG. 2B. The communication hole 15 overlaps with the space (also referred to as a gap) 31*b* in the axial direction. In other words, an axial extent of the communication hole 15 overlaps with an axial extent of the space 31*b*. In this way, the communication hole 15 functions as a second breathing passage 34, which communicates the space 31*a*, the space 31*b* and a space formed around one axial end portion of the plunger 10 to the outside of the yoke 13 to enable flow of fluid therebetween.

The first breathing passage 20 is configured to conduct the fluid between the one end side and the other end side of the plunger 10, and the second breathing passage 34 is configured to conduct the fluid between the inside and the outside of the yoke 13 in the radial direction. Therefore, the first breathing passage 20 and the second breathing passage 34 enable the smooth movement of the plunger 10 in the axial direction in response to the starting and stopping of the energization of the coil 8.

Now, advantages of the present embodiment will be described.

In the linear solenoid 1 of the present embodiment, the communication hole 15 is formed in the peripheral wall portion 13*c* and communicates between the inside and the outside of the yoke 13. Also, the communication hole 15 overlaps with the space 31*b* in the axial direction.

Thereby, the communication hole 15 forms the second breathing passage 34 to enable the flow of the fluid between the inside and the outside of the yoke 13 without requiring the annular gap between the outer peripheral portion of the coil 8 and the peripheral wall portion 13*c*. Therefore, it is possible to eliminate the need for the winding of the coil in the annular gap, which forms the second breathing passage in the prior art technique, and it is also possible to eliminate this gap. Thus, it is possible to meet the demand for increasing the number of winding turns of the coil 8 and the demand for reducing the radial size of the coil 8.

Now, modifications of the above embodiment will be described.

In the hydraulic pressure control valve 2, which has the linear solenoid 1 of the above embodiment, the spool 3 is configured to change the communication state between each corresponding ones of the ports 4 based on the balance of the thrust force outputted from the linear solenoid 1, the urging force of the spring 6 and the feedback force of the hydraulic pressure (oil pressure). Alternatively, the linear solenoid of the present disclosure may be applied to a hydraulic pressure control valve, in which the feedback force of the hydraulic pressure is not applied to the spool.

Furthermore, the linear solenoid 1 of the above embodiment is formed as the component of the hydraulic pressure control valve 2. Alternatively, the linear solenoid 1 may be used as a component of any other suitable devices, which are other than the hydraulic pressure control valve 2.

What is claimed is:

1. A linear solenoid comprising:

a coil;

a plunger that is made of a magnetic material, wherein the plunger is placed on a radially inner side of the coil and is movable in an axial direction;

a yoke that is made of a magnetic material and is configured into a cup form, wherein the yoke includes:

an opening;

a bottom wall portion, which covers one axial end portion of the coil located on one axial side; and a peripheral wall portion, which is configured into a tubular form and covers an outer peripheral portion of the coil;

a stator core that includes:

a magnetically attracting core, which is made of a magnetic material and magnetically attracts the plunger toward another axial side that is axially opposite from the one axial side with a magnetic flux generated through energization of the coil; and a slide core, which is made of a magnetic material and is configured into a tubular form, wherein the slide core is placed on a radially inner side of the coil and covers an outer peripheral portion of the plunger, and the slide core axially slidably supports the plunger and conducts the magnetic flux between the slide core and the plunger in a radial direction, wherein:

the magnetically attracting core and the slide core are integrated with each other along with a magnetic shield portion, which is interposed between the magnetically attracting core and the slide core in the axial direction; and the stator core is inserted into an inside of the yoke from one axial side of the stator core where the slide core is located, and the stator core is fixed to the yoke at the opening; and a communication hole that is empty and is formed in the peripheral wall portion to extend through the peripheral wall portion in a radial direction to communicate between the inside and an outside of the yoke, wherein a gap, which is formed between the one axial end portion of the coil and the bottom wall portion in the inside of the yoke, is communicated with and overlaps with the communication hole in the axial direction.

2. The linear solenoid according to claim 1, wherein:

an axial extent of the communication hole does not overlap with an axial extent of the coil; and a radial extent of the communication hole does not overlap with a radial extent of the coil.

* * * * *